US012490798B2

(12) United States Patent
Kalan

(10) Patent No.: US 12,490,798 B2
(45) Date of Patent: Dec. 9, 2025

(54) STABILIZING OVERSHOE FOR CLEATED FOOTWEAR

(71) Applicant: Wendy Kalan, West Hills, CA (US)

(72) Inventor: Wendy Kalan, West Hills, CA (US)

(73) Assignee: Ssoles, LLC, Miami, FL (US)

( * ) Notice: Subject to any disclaimer, the term of this patent is extended or adjusted under 35 U.S.C. 154(b) by 0 days.

(21) Appl. No.: 18/218,543

(22) Filed: Jul. 5, 2023

(65) Prior Publication Data

US 2025/0009065 A1 Jan. 9, 2025

(51) Int. Cl.
*A43B 3/16* (2022.01)
*A43B 5/18* (2006.01)

(52) U.S. Cl.
CPC ..... *A43B 3/16* (2013.01); *A43B 5/185* (2013.01)

(58) Field of Classification Search
CPC .. A43B 5/185; A43B 5/18; A43B 3/16; A43B 3/18
USPC ..... 36/135
See application file for complete search history.

(56) References Cited

U.S. PATENT DOCUMENTS 4,218,797 A * 8/1980 Sbicca ..... B29D 35/0018 12/142 EV
4,326,345 A * 4/1982 Sbicca ..... B29D 35/10 36/135
8,671,588 B2 * 3/2014 Hampton ..... A43B 3/18 36/7.1 R
2004/0068890 A1 * 4/2004 Palahnuk ..... A43B 5/18 36/7.1 R
2018/0116330 A1 * 5/2018 Christian ..... A43B 13/187

FOREIGN PATENT DOCUMENTS

KR 20130001950 U * 3/2013

OTHER PUBLICATIONS

English Translation of KR20130001950 (Year: 2013).*

* cited by examiner

*Primary Examiner* — Ted Kavanaugh
(74) *Attorney, Agent, or Firm* — Aaron P. McGushion

(57) ABSTRACT

The present stabilizing overshoe includes one or more stabilizers that extend up from the sole of the stabilizing overshoe and overlap the overshoe upper to a height sufficient to at least partially overlay a cleated shoe upper of a cleated shoe inserted within the stabilizing overshoe. The stabilizer augments the rigidity of the overshoe upper to substantially decrease lateral shifting, rolling, and twisting of the cleated shoe relative to the stabilizing overshoe. In one or more embodiments, the overshoe upper is made of an elastic material configured to tightly enclose the cleated shoe, further restricting movement. In one or more embodiments, a stabilizing protrusion protrudes from or is situated atop the insole or the sole of the stabilizing overshoe, such that the stabilizing protrusion is compressed between the sole of the cleated shoe and the sole of the stabilizing overshoe to further grip and hold steady the cleated shoe.

8 Claims, 5 Drawing Sheets

STABILIZING OVERSHOE FOR CLEATED FOOTWEAR

TECHNICAL FIELD

The subject matter disclosed herein generally relates to devices and methods for stabilizing an athlete's ankle while wearing cleats, and, more particularly, overshoes that provides lateral and rolling stability to prevent ankle and other injuries off-field.

BACKGROUND

By way of background, cleated footwear is worn in a number of sports (and in some professions), including soccer, American football, baseball, etc. Although cleated footwear (informally known as "cleats") are meant for use only on the field during gameplay, they are often worn off the field. For example, in adolescent sports, the players will often wear cleats at the playground, restaurants, stores, and so on before or after a game. However, cleats are inherently unstable on many surfaces and can cause injuries to the player's ankles, knees (such as an ACL injury), and other areas. Often, the studs or blades of a cleat are designed for natural turf and cause injury when worn on hard surfaces. The instability of cleats on hard surfaces can cause a sprain, tear, or break due to the shoe tilting, rolling, or shifting laterally relative to the foot.

Therefore, there is a need for a stabilizer for cleated footwear, that the player can quickly engage and disengage as required, to prevent common injuries.

SUMMARY

Aspects of the present devices and methods teach certain benefits in construction and use which give rise to the exemplary advantages described below.

The present devices (and methods for implementation thereof) include, in one or more example embodiments, provide a stabilizing overshoe having an upper having a toe upper portion, a heel upper portion, a first side upper portion, and a second side upper portion spanning between the toe upper portion and the heel upper portion together delineating a cleated shoe opening, and a sole connected to the upper and having a sole bottom portion opposite a sole top portion, a heel sole portion, a toe sole portion, and an arch sole portion therebetween, and a stabilizer extending from the sole upwardly to overlay the upper. In one or more embodiments, the stabilizing overshoe further includes a stabilizing protrusion arranged between the top portion of the sole and a cleated shoe sole to engage at least a portion of the cleated shoe sole.

Other features and advantages of aspects of the present devices and methods will become apparent from the following more detailed description, taken in conjunction with the accompanying drawings, which illustrate, by way of example, the principles of aspects of the invention.

BRIEF DESCRIPTION OF DRAWINGS

The accompanying drawings, which are incorporated in and constitute a part of this specification, illustrate aspects of the disclosed subject matter in at least one of its exemplary embodiments, which are further defined in detail in the following description. Features, elements, and aspects of the disclosure are referenced by numerals with like numerals in different drawings representing the same, equivalent, or similar features, elements, or aspects, in accordance with one or more embodiments. The drawings are not necessarily to scale, emphasis instead being placed upon illustrating the principles herein described and provided by exemplary embodiments of the invention. In such drawings.

Figure 1:
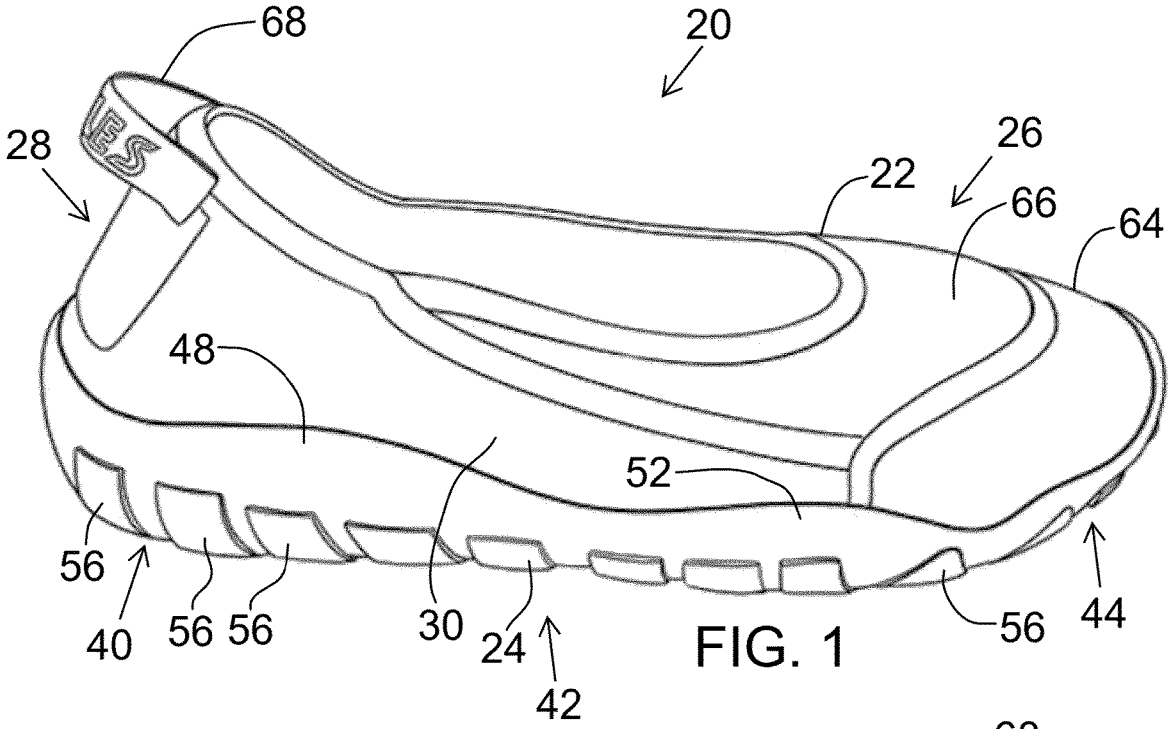
FIG. 1 is a right side view of an example embodiment of the present stabilizing overshoe.
Figure 2:
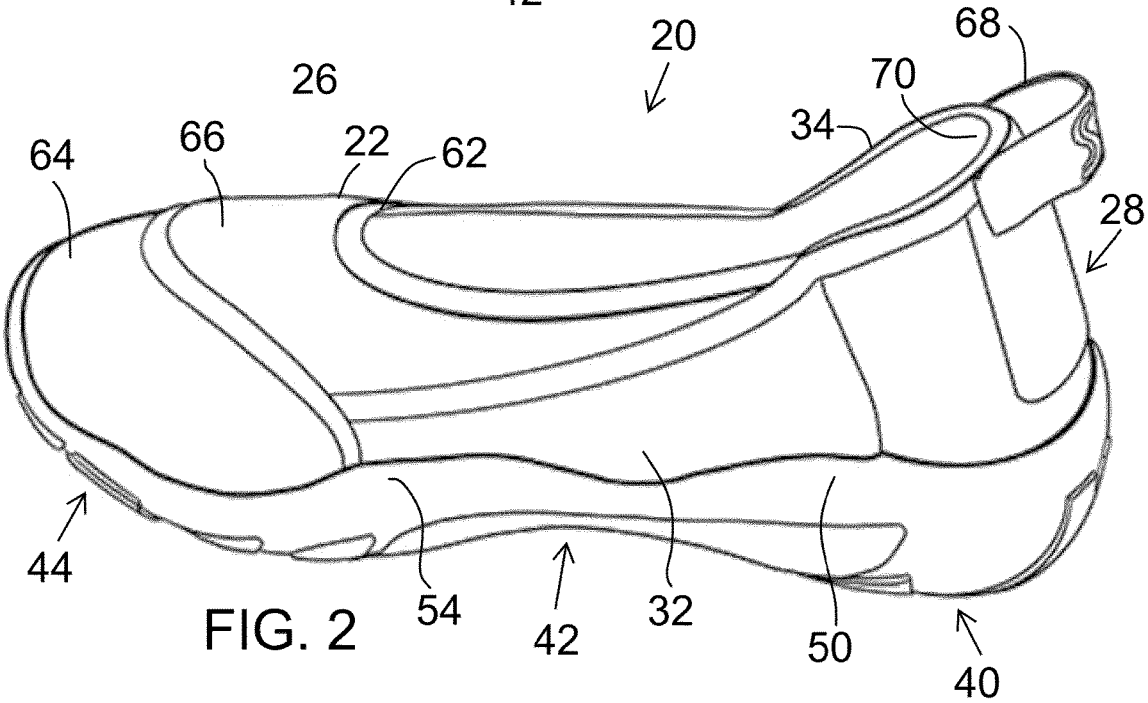
FIG. 2 is a left side view of the stabilizing overshoe of FIG. 1.
Figure 3:
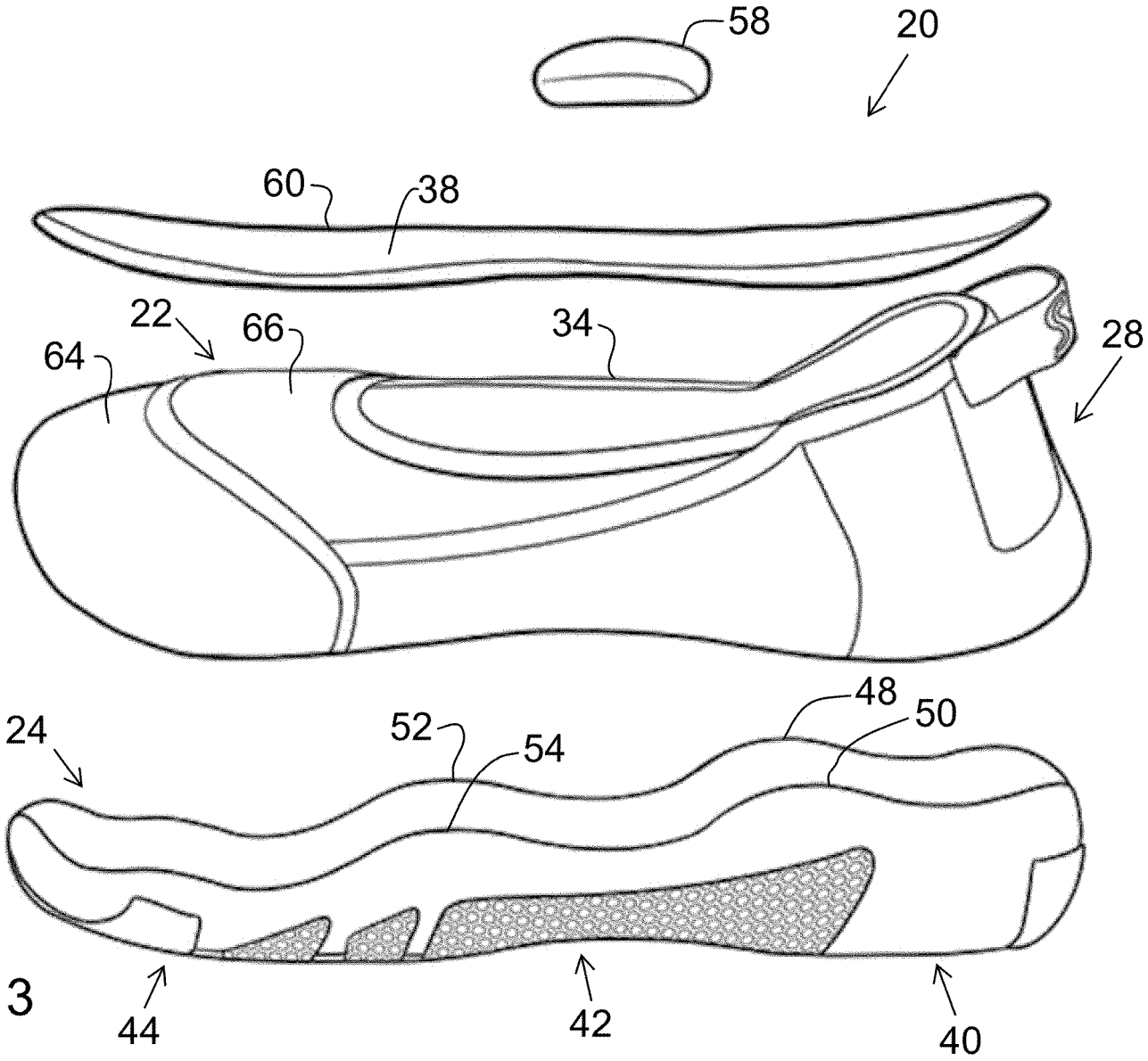
FIG. 3 is an exploded side view of the stabilizing overshoe of FIG. 1.

The above-described drawing figures illustrate aspects of the present stabilizing overshoe in at least one of its exemplary embodiments, which are further defined in detail in the following description.

DETAILED DESCRIPTION

Example devices and methods are directed to a stabilizing overshoe for receiving therein a cleated shoe, and held therein with sufficient stability to prevent unsafe twisting and shifting while the user walks on various surfaces. Examples merely typify possible variations. Unless explicitly stated otherwise, components and functions are optional and may be combined or subdivided, and operations may vary in sequence or be combined or subdivided. In the following description, for purposes of explanation, numerous specific details are set forth to provide a thorough understanding of example embodiments. It will be evident to one skilled in the art, however, that the present subject matter may be practiced without these specific details.

The present stabilizing overshoe includes one or more stabilizers that extend up from the sole of the stabilizing overshoe and overlap the overshoe upper to a height sufficient to at least partially overlay a cleated shoe upper of a cleated shoe inserted within the stabilizing overshoe. The stabilizer augments the rigidity of the overshoe upper to substantially decrease lateral shifting, rolling, and twisting of the cleated shoe relative to the stabilizing overshoe. In one or more embodiments, the overshoe upper is made of an elastic material configured to tightly enclose the cleated shoe, further restricting movement. In one or more embodiments, a stabilizing protrusion protrudes from or is situated atop the insole or the sole of the stabilizing overshoe, such that the stabilizing protrusion is compressed between the sole of the cleated shoe and the sole of the stabilizing overshoe to further grip and hold steady the cleated shoe.

Looking at FIGS. 1-9, an example embodiment of a stabilizing overshoe 20 is illustrated. In one or more embodiments, the stabilizing overshoe 20 includes an upper 22 attached to a sole 24. The upper 22 includes a toe upper portion 26, a heel upper portion 28, with a first side upper portion 30 and a second side upper portion 32 spanning on each side of the stabilizing overshoe 20 between the toe upper portion 26 and the heel upper portion 28, together delineating a cleated shoe opening 34. The upper may further include an inner liner 70 which may be partially or fully comprised of a gripping material (such as a rubber material) which increases friction between the inner liner 70 and the cleated shoe upper U. For example, the inner liner 70 at the heel upper portion 28 can include a patch of gripping material to prevent the cleated shoe CS from slipping out of the stabilizing overshoe 20. A heel pull tab 68 can be included to provide a looped strap for pulling the stabilizing overshoe 20 onto the cleated shoe CS.

In one or more embodiments toe upper portion 26 can be of a single material, multiple materials, or include strips of material to change the characteristics of the toe upper portion 26 (e.g., by making a portion of the toe upper portion 26 more or less flexible or rigid, to make a strengthening strap, etc.). In one or more embodiments, the toe upper portion 26 includes a tox box portion 64, closest to the tip of the toe, and a vamp portion that delineates in part the cleated shoe opening 34. The vamp portion 66 can be made of a more elastic material compared to the toe box portion 64, which permits the toe upper portion 26 to elastically stretch to further open the cleated shoe opening 34 while inserting the cleated shoe CS, to make insertion easier. In one or more embodiments, the vamp portion 66 is made of an elastic mesh material. In one or more embodiments, the vamp portion 66 overlays the vamp V of the cleated shoe CS; and the forward portion 62 of the cleated shoe opening 34 provides clearance such that the laces of the cleated shoe CS are not covered or are only covering the most forward one or two sets of eyelets. This prevents the forward portion 62 of the cleated shoe opening 34 from snagging the laces, the eyelets, the throat, etc. of the cleated shoe CS. In one or more embodiments, substantially all or most of the upper 22 is made of an elastic material configured to be stretched over the cleated shoe CS to further restrict the movement of the cleated shoe CS within the stabilizing overshoe 20.

The sole 24 may include multiple layers (e.g., outsole, midsole, insole, etc.) or just a single molded sole 24 (e.g., made from rubber, plastic, or other appropriate material). In the illustrated example embodiment, the outsole portion of the sole 24 is injection molded to include the various traction lugs and other features on the bottom portion 36, as well as the stabilizers extending upwardly, as described in greater detail below. Optionally, the sole 24 can include an insole 60 inserted atop the outsole within the shoe. When referencing the top portion 38 of the sole 24, this may be the top of the unitarily-molded (or overmolded) outsole or the top of the insole 60 overlaying the outsole. The insole 60 can include a top surface material (such as a fabric material) with sufficiently low coefficient of friction to reduce snagging and friction between the cleats C of the cleated shoe CS during insertion, as the cleats C are sliding across the insole 60. This lower friction material may be only present in the toe sole portion 44 of the insole 60, as this is the region where the cleats C are most likely to snag on higher friction material.

The sole 24 extends upward about all or parts of the perimeter edge of the sole 24 to form one or more stabilizers 48, 50, 52, 54. In the illustrated example embodiment, four portions of the sole 24 perimeter edge extend upwardly to overlay the upper 22 of the stabilizing overshoe 20 (with the sole 24 adhered securely to the upper 22); and each have sufficient height to additionally overlay the cleated shoe upper U positioned beneath the stabilizing overshoe 20 upper 22 when the cleated shoe CS is in the fully inserted configuration. In particular, there is a first heel stabilizer 48 substantially opposing a second heel stabilizer 50 and a first toe stabilizer 52 substantially opposing a second toe stabilizer 54. Although four separate stabilizers are illustrated (where portions of the sole 24 extends well above lower portions of the perimeter edge), more or fewer stabilizers may be present or the stabilizers may extend completely from the heel sole portion 40 to the toe sole portion (i.e., where the first side upper portion 30 and/or the second side upper portion 32 are overlayed by the stabilizer.

In this example, the first heel stabilizer 48, the second heel stabilizer 50, the first toe stabilizer 52, and the second toe stabilizer 54 are flaps extending upwardly from the body of the sole 24, and are glued to the upper 22. The thickness of the stabilizers 48, 50, 52, 54 combined with lamination on the stabilizers 48, 50, 52, 54 over the upper 22 creates a rigid region of the vertical (or somewhat vertical) portions of the upper 22, that resists excessive bulging and flexing due forces exerted by the cleated shoe CS therein during walking, play, and other off-field activities. The stabilizers 48, 50, 52, 54 extend to overlay the cleated shoe upper U, and can extend at least one quarter of the height of the upper 22 of stabilizing overshoe 20 (as measured from the bottom of the upper to the cleated shoe opening 34), or can extend at least one third of the height of the upper 22 of stabilizing overshoe 20, or can extend at least one half of the height of the upper 22 of stabilizing overshoe 20, or can extend at least two thirds of the height of the upper 22 of stabilizing overshoe 20, or can extend at least three quarters of the height of the upper 22 of stabilizing overshoe 20, or can extend from the bottom of the upper 22 up to substantially the cleated shoe opening 34 (e.g., up to the very edge of the cleated shoe opening 34 or almost to the edge, within 10% of the total height). Although the stabilizers 48, 50, 52, 54 are illustrated as being integrally molded with the sole 24, they can be adhered to the upper 22, and optionally also to the sole 26, as a separate part.

In one or more example embodiments, one or more stiffening structures 56 is included on one or more of the stabilizers 48, 50, 52, 54. In the illustrated example embodiment, the stiffening structures 56 are ribs or raised strips of material. However, other structures known to increase rigidity can be used, such as vertical corrugations, varying the thickness of the stabilizers 48, 50, 52, 54 along the height, width, diagonal, and so on. The stiffening structures 56 can be arranged on some or all of the stabilizers 48, 50, 52, 54; and, the heights of the stiffening structures 56 can vary, such that two successive ribs may be the same height or differing heights. The stiffening structures 56 can extend at least one quarter the height of the stabilizers 48, 50, 52, 54, or extend at least one half the height of the stabilizers 48, 50, 52, 54, or extend at least three quarters the height of the stabilizers 48, 50, 52, 54, or extend at least the height of the stabilizers 48, 50, 52, 54, or extend at least beyond the height of the stabilizers 48, 50, 52, 54 (i.e., directly overlaying the upper 22).

In one or more example embodiments, one or more stabilizing protrusions 58 is provided atop the sole 24 (or atop the top portion 38 or surface the insole 60), where the stabilizing protrusion 58 can be integrally molded with any portion of the sole 24, or permanently attached to the sole 24 (in the factory or by the end user), or temporarily attached to the sole 24 (i.e., the stabilizing protrusion 58 can be attached and reattached in various positions). The stabilizing protrusion 58 is configured to be positioned between the top portion 38 of the sole 24 and a cleated shoe sole S to engage at least a portion of the cleated shoe sole CS. In one or more embodiments, the stabilizing protrusion 58 can be positioned between cleats C (the lugs or blades of the cleated shoe CS), and in particular, in the shank portion of the cleated shoe CS between the set of cleats C at the toe and the set of cleats C at the heel. The stabilizing protrusion 58 can be elastically (temporarily) deformable or permanently deformable so that an imprint of the sole S of the cleated shoe CS is permanently imparted on the stabilizing protrusion 58. The stabilizing protrusion 58 can be any number of shapes, including, but not limited to, hemispherical, hemicylindrical, cuboid, etc. The stabilizing protrusion 58 may be adhered to the top portion 38 or held thereto by hook and loop or similar bonding.

The stabilizing protrusion 58 provides an additional region of contact between the sole 24 of the stabilizing overshoe 20 and the sole S of the cleated shoe CS, where the stabilizing protrusion 58 can deform to cradle (i.e., conforming to the bottom of the sole S and, optionally, extending above the sole S on one or both sides to provide overlap and mechanical interference between the stabilizing protrusion 58 and the sole S to prevent lateral movement) the sole S of the cleated shoe CS and/or provide additional friction between the stabilizing protrusion 58 and the sole S to prevent excessive movement of the cleated shoe CS within the stabilizing overshoe 20. As such, the stabilizing protrusion 58 can be made of wholly or partially of a material with a high coefficient of friction, such as rubber, silicon, etc.

Figure 4:
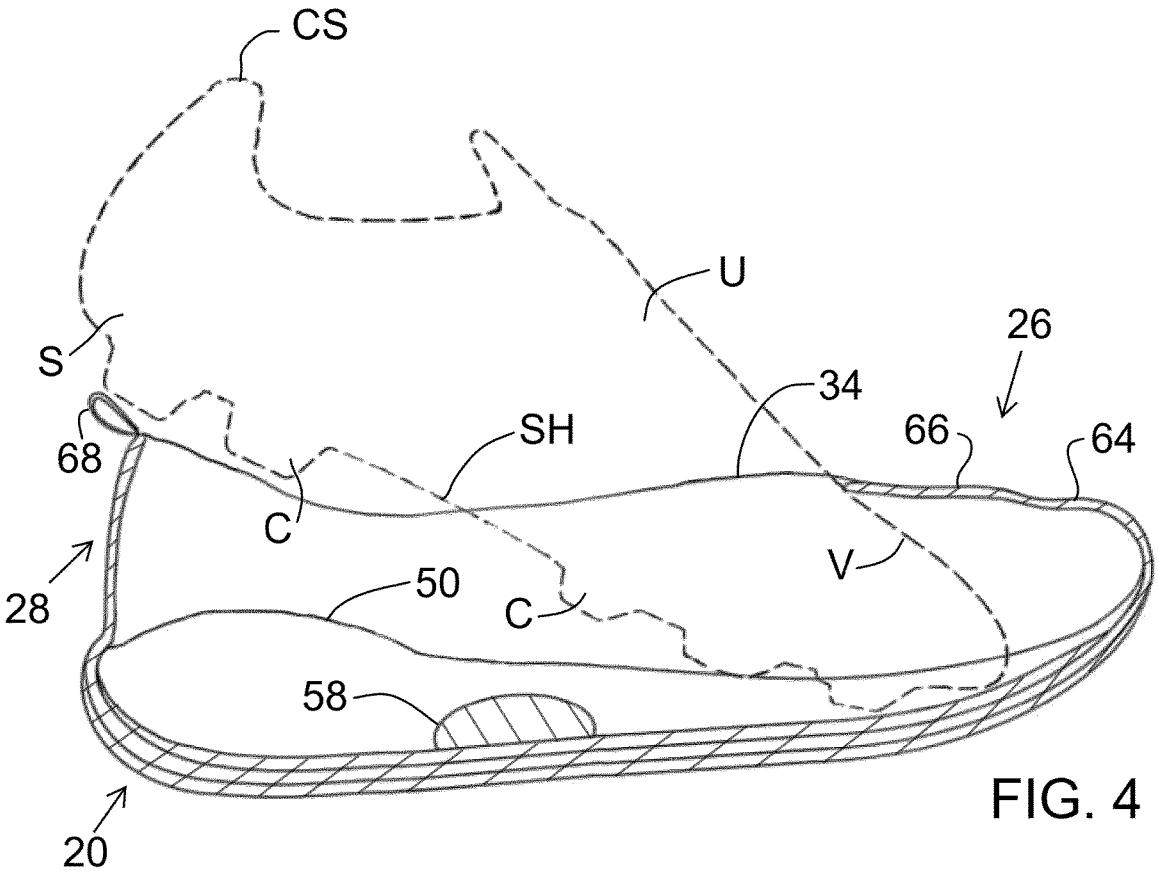
FIG. 4 is a longitudinal cross-sectional view of the stabilizing overshoe of FIG. 1, illustrating cleated footwear in the process of being inserted therein.
Figure 5:
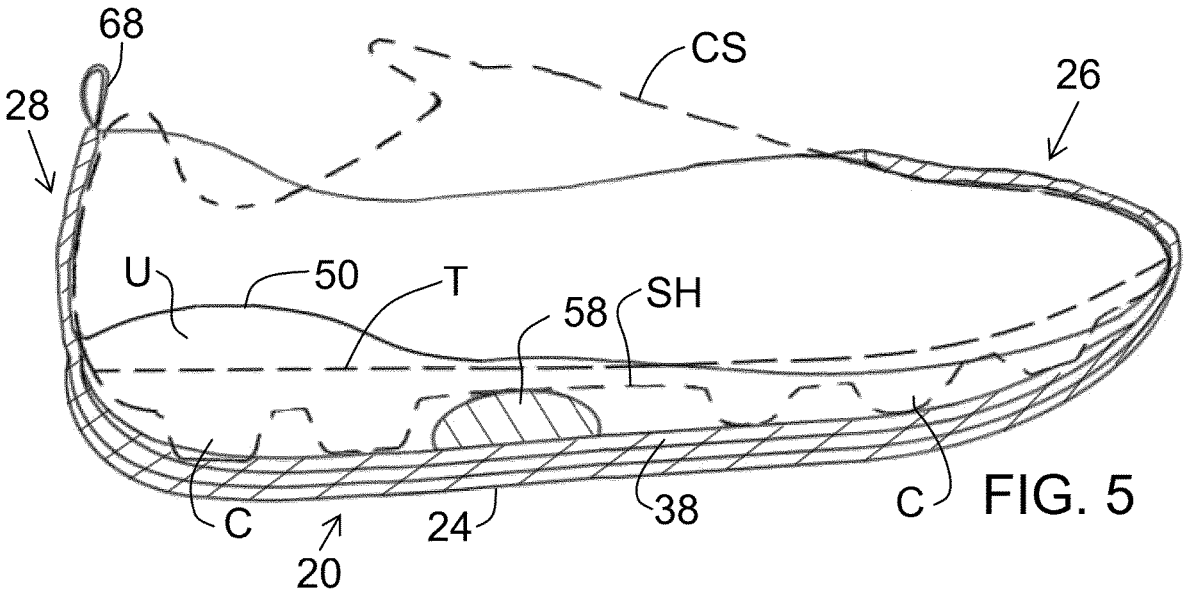
FIG. 5 is a longitudinal cross-sectional view of the stabilizing overshoe of FIG. 4, illustrating cleated footwear fully inserted therein.
Figure 6:
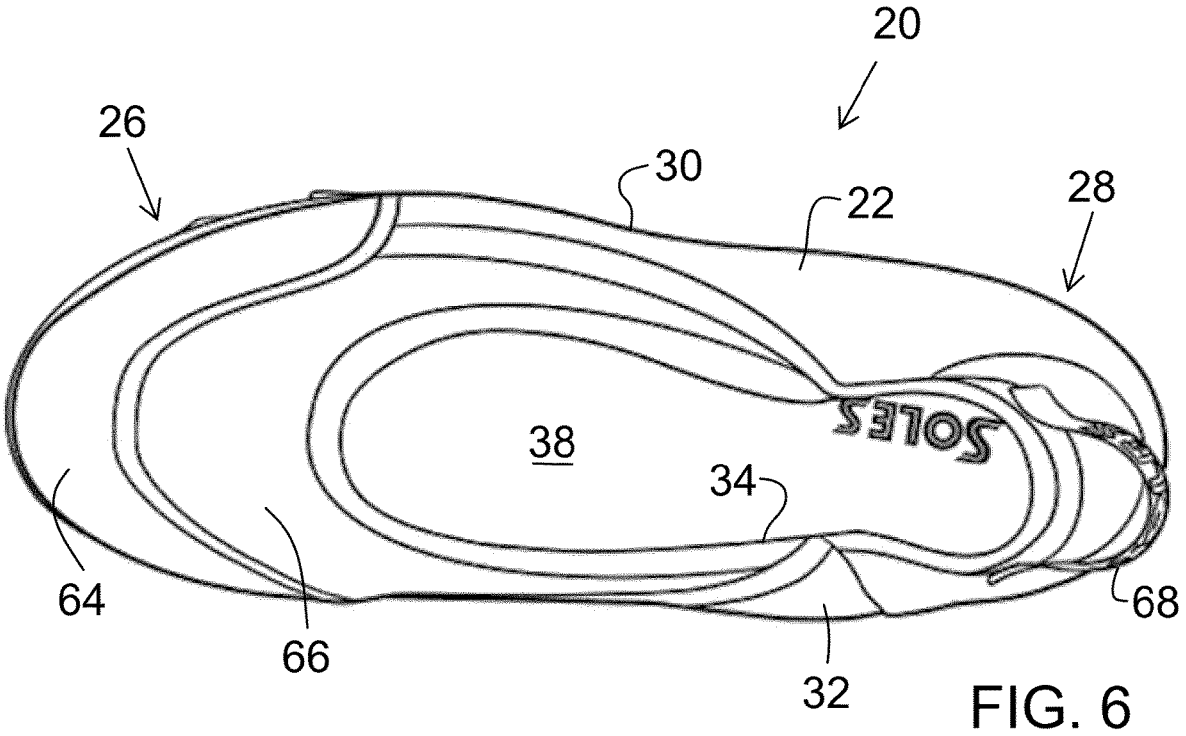
FIG. 6 is a top view of the stabilizing overshoe of FIG. 1.

Looking particularly at FIGS. 4-5, the method of inserting the cleated shoe CS into the stabilizing overshoe 20 is illustrated, where the user (generally while wearing the cleated shoe CS) inserts the cleated shoe CS, toe first, through the cleated shoe opening 34 of the stabilizing overshoe 20 to position the vamp V of the cleated shoe CS beneath the toe upper portion 26 of the stabilizing overshoe 20. The user can insert a finger into the heel pull tab 68 to stretch the heel upper portion 28 upward and backward to provide clearance for the cleated shoe CS heel to be inserted into the stabilizing overshoe 20. Once in the inserted configuration of FIG. 5, it can be seen that the second heel stabilizer 50 extends above the height of the cleats C and above the height of the outsole top T (illustrated as a dashed line). Further, the shank SH of the cleated shoe CS is atop the stabilizing protrusion 58 and partially compressing it.

Figure 7:
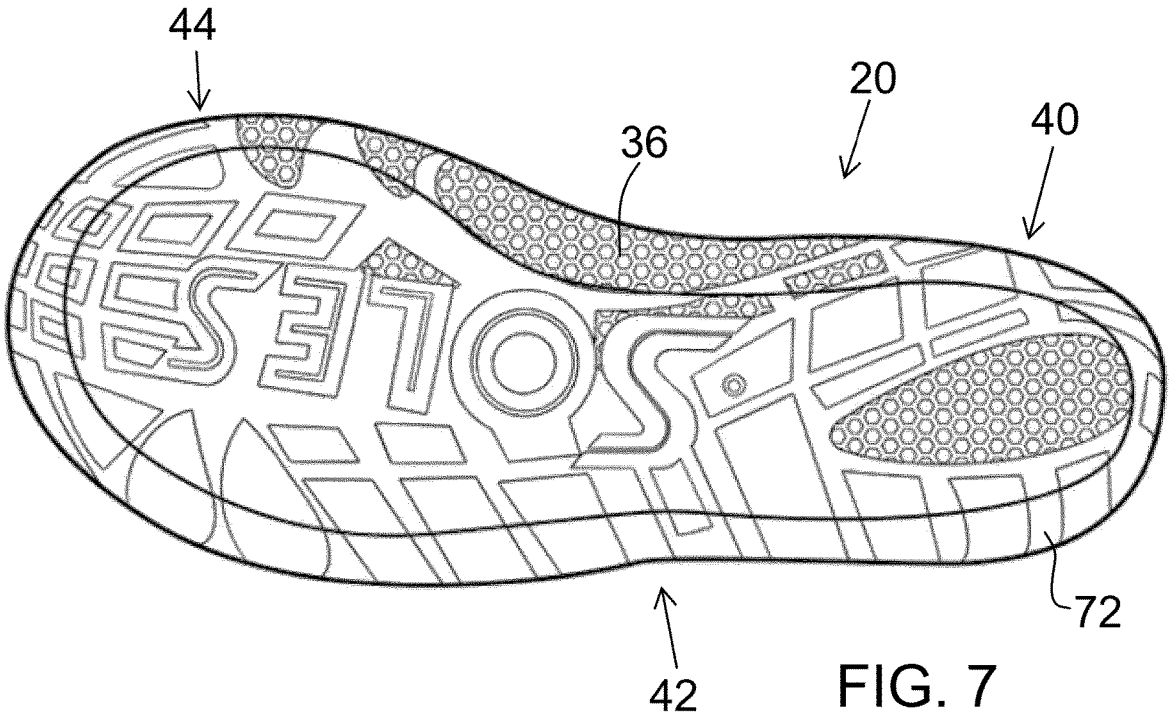
FIG. 7 is a bottom view of the stabilizing overshoe of FIG. 1.
Figure 8:
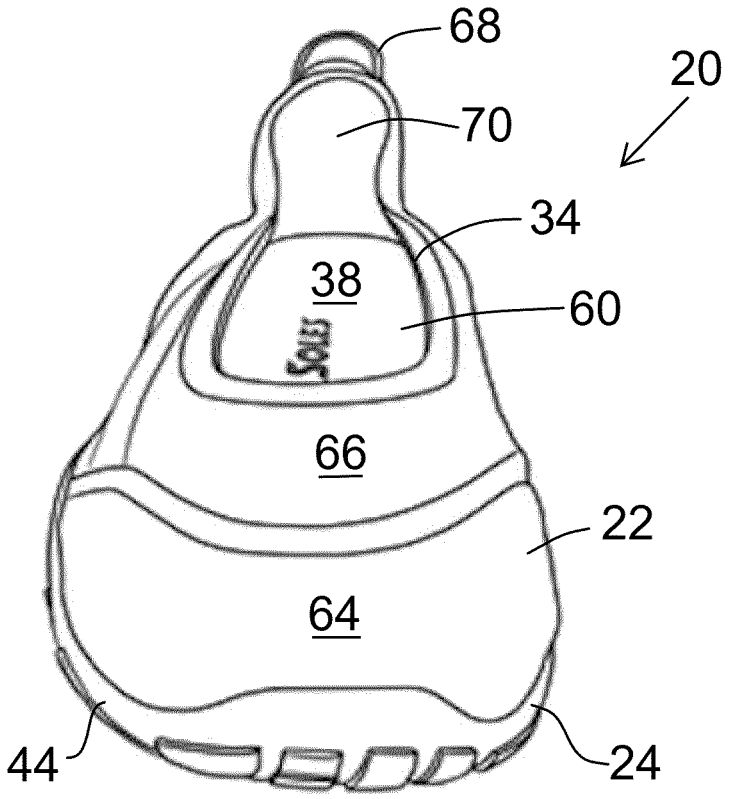
FIG. 8 is a front view of the stabilizing overshoe of FIG. 1.
Figure 9:
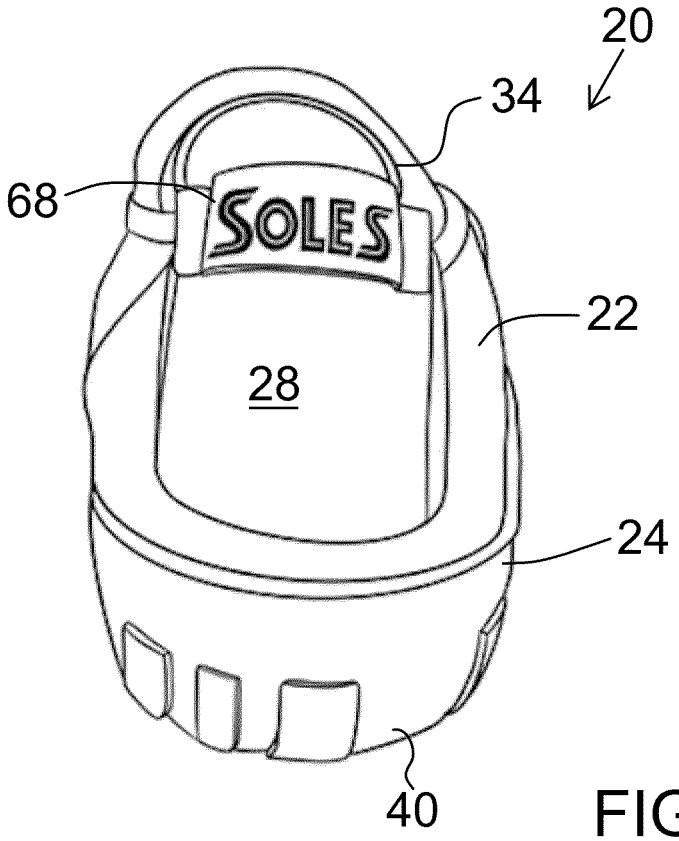
FIG. 9 is a back view of the stabilizing overshoe of FIG. 1.

In FIG. 7, the bottom portion 36 of the sole 24 is illustrated, showing one of many available designs. In one or more embodiments, the bottom portion 36 provides a stable and substantially level platform upon which to walk, where the outer perimeter region 72 of the bottom portion 36 in at least the heel sole portion 40 (and optionally to the arch sole portion 42, and optionally to the toe sole portion 44) is level, that is, the lugs, stiffening structures 56, and other design protrusions are of the same height or arranged with heights that create a level bottom portion 36 when measuring from lug to lug (or other protrusions) so that the user experiences a level stable platform upon which to walk, to prevent a left or right angled incline of the top surface 38.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The Detailed Description, therefore, is not to be taken in a limiting sense, and the scope of various embodiments is defined only by the appended claims, along with the full range of equivalents to which such claims are entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

What is claimed is:

1. A stabilizing overshoe for receiving therein a cleated shoe, the stabilizing overshoe comprising:

an upper having a toe upper portion, a heel upper portion, a first side upper portion, and a second side upper portion spanning between the toe upper portion and the heel upper portion together delineating a cleated shoe opening configured to receive therethrough the cleated shoe;

a sole connected to the upper, the sole having a bottom portion configured to contact a walking surface, a top portion configured to support the cleated shoe thereon, a heel sole portion, a toe sole portion, and an arch sole portion between the heel sole portion and the toe sole portion;

a heel stabilizer having a heel stabilizer height extending from the heel sole portion and upwards to overlay the upper at the heel upper portion;

a toe stabilizer having a toe stabilizer height extending from the toe sole portion and upwards to overlay the upper at the toe upper portion; and a plurality of stiffening ribs formed on the heel stabilizer and the toe stabilizer, the plurality of stiffening ribs extending from the bottom portion of the sole to at least half the heel stabilizer height and to at least half the toe stabilizer height;

wherein, a heel stabilizer height and a toe stabilizer height are configured to extend upward to overlay at least a portion of a cleated shoe upper when the cleated shoe is in the inserted configuration.

2. The stabilizing overshoe of claim 1 wherein the sole further comprises a second heel stabilizer substantially opposing the heel stabilizer and a second toe stabilizer substantially opposing the toe stabilizer.

3. The stabilizing overshoe of claim 2 wherein a second plurality of stiffening ribs are formed on a second heel stabilizer and the toe stabilizer, the second plurality of stiffening ribs extending from the bottom portion of the sole to at least half a second heel stabilizer height and to at least half a second toe stabilizer height.

4. The stabilizing overshoe of claim 1 wherein an elastically deformable stabilizing protrusion is arranged on the top portion of the sole, and wherein, when in the inserted configuration, the stabilizing protrusion is configured to be positioned between the top portion of the sole and a cleated shoe sole to engage at least a portion of the cleated shoe sole.

5. The stabilizing overshoe of claim 4 wherein the stabilizing protrusion is configured to be compressed and conformed to the cleated shoe sole when the cleated shoe is in the inserted configuration to substantially prevent excessive movement of the cleated shoe.

6. The stabilizing overshoe of claim 5 wherein the stabilizing protrusion is arranged on the top portion of the sole located on the arch portion.

7. The stabilizing overshoe of claim 4 wherein the stabilizing protrusion is repositionable on the top portion of the sole.

8. The stabilizing overshoe of claim 1 wherein the toe upper portion comprises a toe box and an elastic vamp between the cleated shoe opening and the toe box, wherein the vamp partially delineates the cleated shoe opening.

* * * * *